US010641086B2

(12) United States Patent
Lee et al.

(10) Patent No.: US 10,641,086 B2
(45) Date of Patent: May 5, 2020

(54) PRESSURE COMPENSATION DEVICE FOR A FLUID PRESSURE PULSE GENERATING APPARATUS

(71) Applicant: Evolution Engineering Inc., Calgary, Alberta (CA)

(72) Inventors: Gavin Gaw-Wae Lee, Calgary (CA); Justin C. Logan, Calgary (CA); Aaron W. Logan, Calgary (CA)

(73) Assignee: EVOLUTION ENGINEERING INC., Calgary, Alberta (CA)

( * ) Notice: Subject to any disclaimer, the term of this patent is extended or adjusted under 35 U.S.C. 154(b) by 387 days.

(21) Appl. No.: 15/551,546

(22) PCT Filed: Feb. 16, 2016

(86) PCT No.: PCT/CA2016/050140

§ 371 (c)(1),
(2) Date: Aug. 16, 2017

(87) PCT Pub. No.: WO2016/131135

PCT Pub. Date: Aug. 25, 2016

(65) Prior Publication Data

US 2018/0045042 A1 Feb. 15, 2018

Related U.S. Application Data

(60) Provisional application No. 62/117,813, filed on Feb. 18, 2015.

(51) Int. Cl.
*E21B 47/18* (2012.01)

(52) U.S. Cl.
CPC ..... *E21B 47/18* (2013.01); *E21B 47/182* (2013.01)

(58) Field of Classification Search
CPC combination set(s) only.
See application file for complete search history.

(56) References Cited

U.S. PATENT DOCUMENTS 4,329,127 A 5/1982 Tschirky et al.
7,719,439 B2 5/2010 Pratt et al.
(Continued)

FOREIGN PATENT DOCUMENTS

CA 2899718 A1 8/2014

OTHER PUBLICATIONS

International Search Report & Written Opinion dated May 5, 2016 for related PCT App. No. PCT/CA2016/050140.
(Continued)

*Primary Examiner* — Hovhannes Baghdasaryan
*Assistant Examiner* — Amie M Ndure
(74) *Attorney, Agent, or Firm* — D'Ambrosio & Menon, PLLC; Usha Menon

(57) ABSTRACT

A pressure compensation device for a downhole fluid pressure pulse generator comprising: a membrane sleeve; a membrane support with a bore for receiving a drive-shaft, a central section which receives the membrane sleeve, a male mating section on each side, each having a groove extending around an external surface and at least one opening aligned with the groove; a pair of female mating components with a bore and a channel in an internal surface, each female mating component configured to mate with one of the male mating sections to axially clamp the membrane sleeve between the membrane support and the female mating components; and a pair of retaining rings each received between the male mating section groove and the female mating component channel, where the retaining rings are accessible through the opening in the male mating section and radially expandable into a space in the female mating
(Continued)

component to unseat the retaining ring from the groove for removal.

12 Claims, 8 Drawing Sheets

(56) References Cited

U.S. PATENT DOCUMENTS

| | | | |
|---|---|---|---|
| 8,203,908 | B2 | 6/2012 | Pratt et al. |
| 2005/0199423 | A1 | 9/2005 | Moriarty |
| 2014/0124693 | A1 | 5/2014 | Gopalan et al. |

OTHER PUBLICATIONS

International Preliminary Report on Patentability dated Aug. 22, 2017 for related PCT App. No. PCT/CA2016/050140.

PRESSURE COMPENSATION DEVICE FOR A FLUID PRESSURE PULSE GENERATING APPARATUS

FIELD

This invention relates generally to a pressure compensation device for a fluid pressure pulse generating apparatus.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight grounding subs. The BHA is conveyed into the wellbore by a string of metallic tubulars (i.e. drill pipe).

MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

Known MWD tools contain essentially the same sensor package to survey the well bore; however the data may be sent back to surface by various telemetry methods. Such telemetry methods include, but are not limited to, the use of hardwired drill pipe, acoustic telemetry, use of fibre optic cable, Mud Pulse (MP) telemetry and Electromagnetic (EM) telemetry. The sensors are usually located in an electronics probe or instrumentation assembly contained in a cylindrical cover or housing, located near the drill bit.

MP telemetry involves creating pressure waves ("pulses") in the drill mud circulating through the drill string. Mud is circulated from surface to downhole using positive displacement pumps. The resulting flow rate of mud is typically constant. The pressure pulses are achieved by changing the flow area and/or path of the mud as it passes the MWD tool in a timed, coded sequence, thereby creating pressure differentials in the mud. The pressure differentials or pulses may be either negative pulses or positive pulses. Valves that open and close a bypass mud stream from inside the drill pipe to the wellbore annulus create a negative pressure pulse. Valves that use a controlled restriction within the circulating mud stream create a positive pressure pulse. Pulse frequency is typically governed by pulse generator motor speed changes. The pulse generator motor requires electrical connectivity with the other elements of the MWD tool.

The pulse generating motor driveline system is subjected to extreme pressure differentials of about 20,000 psi between the external and internal aspects of the MWD tool when the MWD tool is downhole. To accommodate this large pressure differential, the mud is allowed access to areas of the MWD tool which are positioned on one side of a pressure compensation mechanism. Pressure is equalized on the other side of the pressure compensation mechanism within the tool using clean lubrication liquid, such as hydraulic fluid or silicon oil. One type of pressure compensation mechanism uses a flexible membrane positioned on a support surrounding a driveshaft of the MWD tool. The flexible membrane is typically attached to the support using wire and can flex in response to pressure differentials in the mud allowing pressure equalization between the mud external to the membrane and the lubrication liquid internal to the membrane.

SUMMARY

According to a first aspect, there is provided a pressure compensation device for a downhole fluid pressure pulse generating apparatus comprising a membrane sleeve, a membrane support, a pair of female mating components, and a pair of retaining rings. The membrane support comprises a body with a bore therethrough for receiving a driveshaft of the fluid pressure pulse generating apparatus. The body comprises a central section which receives the membrane sleeve and a male mating section either side of the central section. Each male mating section has a groove extending around at least a portion of an external surface thereof and at least one opening therethrough with the opening being in alignment with the groove. Each of the pair of female mating components comprises an inner end and an outer end with a bore therethrough and at least one channel extending around at least a portion of an internal surface thereof. Each of the female mating components is configured to mate with one of the male mating sections to axially clamp the membrane sleeve between the body and the female mating components. Each of the pair of retaining rings is received in the channel of one of the female mating components and in the groove of one of the male mating sections such that the retaining ring is positioned between the male mating section and the female mating component to retain the female mating component on the male mating section. The retaining ring is accessible through the opening in the male mating section and radially expandable into a space between the retaining ring and the female mating component to unseat the retaining ring from the groove for removal of the female mating component from the male mating section.

The pressure compensation device may further comprise an outer sleeve surrounding the membrane sleeve with a space therebetween. Each of the female mating components may comprise an outer sleeve receiving section on an external surface thereof which receives an end portion of the outer sleeve with a space therebetween.

The membrane support may further comprise a pair of shoulders surrounding the body, with each shoulder positioned between the central section and one of the male mating sections. Each of the shoulders may taper towards the male mating sections to form a sloped wall. The inner end of each of the female mating components may have a sloped surface. The membrane sleeve may be axially clamped between the sloped wall and the sloped surface when the female mating component is mated with the male mating section. The membrane sleeve may comprise a central portion and a sloped end portion either side of the central portion. The taper of the sloped end portion may correspond to the taper of the sloped wall and each sloped end portion may be axially clamped between one of the sloped walls and the sloped surface of one of the female mating components.

The central section of the body of the membrane support may further comprise at least one longitudinally extending slot therethrough.

At least one of the female mating components may comprise one or more pair of projections comprising an inner projection and an outer projection on an internal surface thereof with the channel extending between the inner projection and the outer projection. At least one of the male mating sections may comprise a corresponding number of teeth defining one or more slot therebetween. The groove may extend around an external surface of the teeth and the opening through the body may be provided by the slot. The slot may receive the pair of projections when the female mating component is mated with the male mating section. An outer external edge of the teeth may be bevelled. An inner internal edge of the inner projection may be bevelled.

The outer end of at least one of the female mating components may comprise one or more threaded bore for receiving a threaded screw for releasably securing one of the retaining rings in the groove on the external surface of one of the male mating sections.

According to another aspect, there is provided a fluid pressure pulse generating apparatus for downhole drilling comprising a fluid pressure pulse generator and a pulser assembly. The pulser assembly comprises: a housing with one or more opening therethrough; a motor enclosed by the housing; a driveshaft extending from the motor out of the housing and coupled with the fluid pressure pulse generator; the pressure compensation device of the first aspect enclosed by the housing and surrounding a portion of the driveshaft, wherein an outer surface of the membrane is in fluid communication with the opening in the housing and an inner surface of the membrane is in fluid communication with the driveshaft; and a seal enclosed by the housing and surrounding a portion of the driveshaft between the fluid pressure pulse generator and the pressure compensation device.

This summary does not necessarily describe the entire scope of all aspects. Other aspects, features and advantages will be apparent to those of ordinary skill in the art upon review of the following description of specific embodiments.

DETAILED DESCRIPTION

Directional terms such as "uphole" and "downhole" are used in the following description for the purpose of providing relative reference only, and are not intended to suggest any limitations on how any apparatus is to be positioned during use, or to be mounted in an assembly or relative to an environment.

The embodiments described herein relate generally to a pressure compensation device for a fluid pressure pulse generating apparatus.

Figure 1:
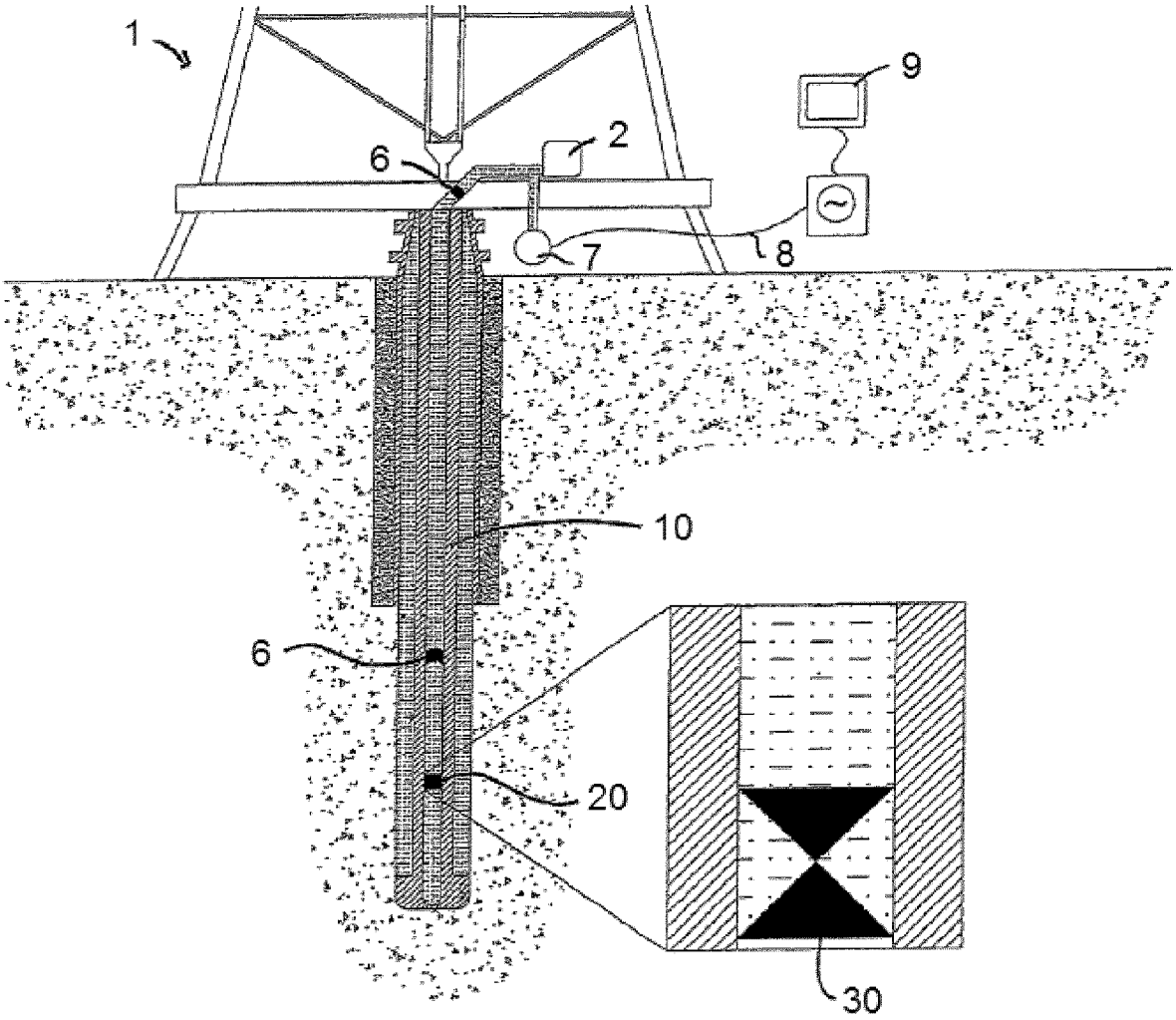
FIG. 1 is a schematic of a mud pulse (MP) telemetry method in a drill string in an oil and gas borehole using a MWD telemetry tool.

Referring to the drawings and specifically to FIG. 1, there is shown a schematic representation of a MP telemetry operation using a MWD tool 20. In downhole drilling equipment 1, drilling mud is pumped down a drill string by pump 2 and passes through the MWD tool 20 which includes a fluid pressure pulse generator 30. The fluid pressure pulse generator 30 has an open position in which mud flows relatively unimpeded through the fluid pressure pulse generator 30 and no pressure pulse is generated and a restricted flow position where flow of mud through the fluid pressure pulse generator 30 is restricted and a positive pressure pulse is generated (represented schematically as block 6 in mud column 10). Information acquired by downhole sensors (not shown) is transmitted in specific time divisions by pressure pulses 6 in the mud column 10. More specifically, signals from sensor modules in the MWD tool 20, or in another downhole probe (not shown) communicative with the MWD tool 20, are received and processed in a data encoder in the MWD tool 20 where the data is digitally encoded as is well established in the art. This data is sent to a controller in the MWD tool 20 which then actuates the fluid pressure pulse generator 30 to generate pressure pulses 6 which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency and these characteristics are used in various encoding systems to represent binary data.

The MWD tool 20 generally comprises the fluid pressure pulse generator 30 and a pulser assembly which takes measurements while drilling and which drives the fluid pressure pulse generator 30. The fluid pressure pulse generator 30 and pulser assembly are axially located inside a drill collar with an annular gap therebetween to allow mud to flow through the gap. The fluid pressure pulse generator 30 may be downhole of the pulser assembly and generally comprises a stator and a rotor. The pulser assembly and stator are fixed to the drill collar, and the rotor is rotated by the pulser assembly relative to the stator to generate fluid pressure pulses 6.

Figure 2:
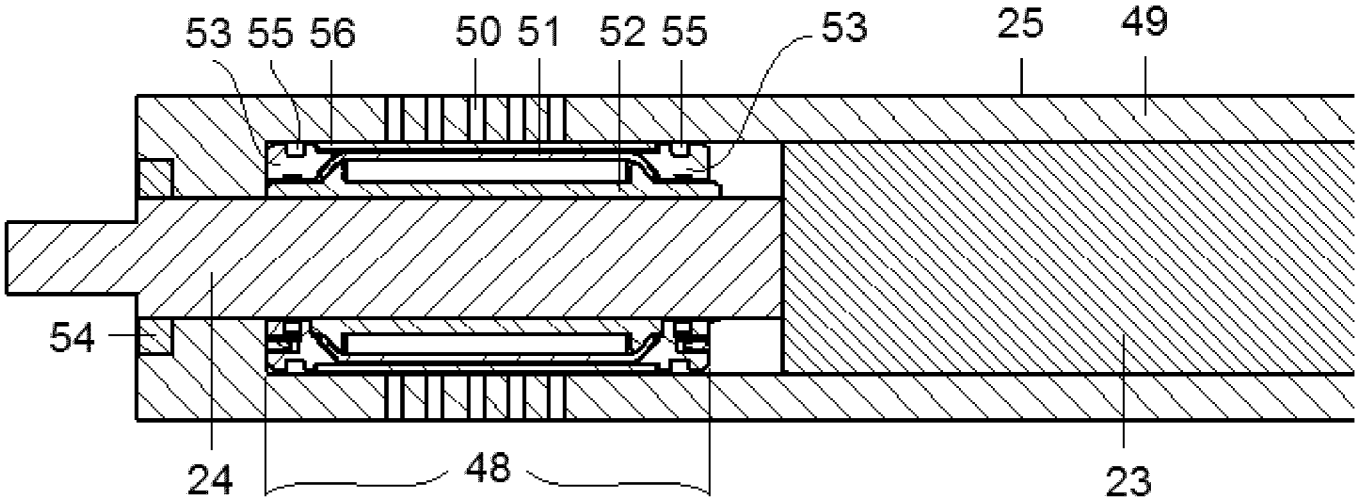
FIG. 2 is a longitudinally sectioned view of a mud pulser section of the MWD tool comprising a pressure compensation device according to an embodiment.
Figure 3:
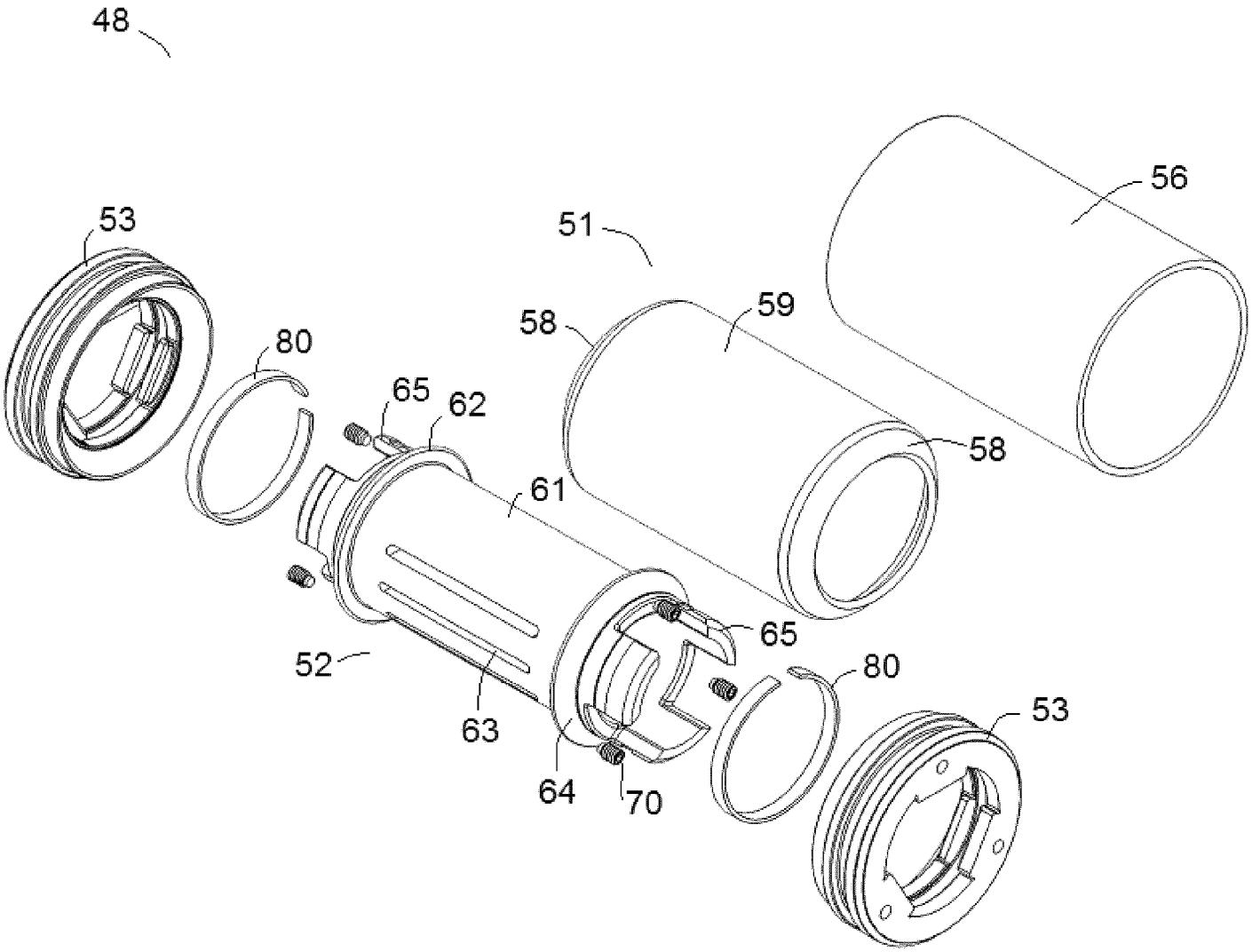
FIG. 3 is a perspective expanded view of the pressure compensation device comprising an outer sleeve, a membrane sleeve, a membrane support and two female mating components with retaining rings for mating with the membrane support to axially clamp the membrane sleeve between the membrane support and the female mating components.

Referring to FIG. 2, the downhole end of the pulser assembly of the MWD tool 20 is shown in more detail. The pulser assembly includes a motor subassembly 25 and an electronics subassembly (not shown) electronically coupled together but fluidly separated. The motor subassembly 25 includes a motor subassembly housing 49 which houses components including a motor and gearbox assembly 23, a driveshaft 24 extending from the motor and gearbox assembly 23, and a pressure compensation device 48 surrounding the driveshaft 24. The electronics subassembly houses downhole electronics including sensors, control electronics, and other components required by the MWD tool 20 to determine the direction and inclination information and to take measurements of drilling conditions, to encode this telemetry data using one or more known modulation techniques into a carrier wave, and to send motor control signals to the motor of the motor and gearbox assembly 23 to rotate the drive shaft 24 in a controlled pattern to generate pressure pulses 6 representing the carrier wave for transmission to surface.

The motor subassembly 25 is filled with a lubrication liquid such as hydraulic oil or silicon oil, and the lubrication liquid is contained inside the motor subassembly housing 49 by a rotary seal 54 which provides a fluid seal between the driveshaft 24 and the motor subassembly housing 49. As will be discussed in more detail below, the pressure compensation device 48 comprises a flexible membrane sleeve 51 in fluid communication with the lubrication liquid on one side and with mud on the other side via openings 50 in the motor subassembly housing 49. The membrane sleeve 51 can flex to compensate for pressure changes in the mud and allows the pressure of the lubrication liquid to substantially equalize with the pressure of the mud. Without pressure compensation, the torque required to rotate the driveshaft 24 would need high current draw with excessive battery consumption resulting in increased costs.

Referring now to FIGS. 3 to 8 there is shown an embodiment of the pressure compensation device 48 comprising a cylindrical membrane support 52, a membrane sleeve 51 surrounding the membrane support 52, and a pair of female mating components 53 and retaining rings 80 that mate with opposing ends of the membrane support 52 to axially clamp the membrane sleeve 51 between the membrane support 52 and the female mating components 53 as will be described in more detail below. Surrounding the membrane sleeve 51 is an outer sleeve 56 with a small annular space therebetween.

The membrane support 52 comprises a body with a central bore therethrough which receives the driveshaft 24. The body comprises a longitudinally extending central section 61 and a male mating section 65 either side of the central section 61 for mating with the female mating components 53. Longitudinally extending slots 63 in the central section 61 allow lubrication liquid surrounding the driveshaft 24 to flow through the body and contact the internal surface of the membrane sleeve 51. An annular shoulder 62 is positioned between the central section 61 and each male mating section 65. The opposed facing sides of each of the annular shoulders 62 are perpendicular to the central section 61 and the circumference of each of the annular shoulders 62 tapers towards the male mating sections 65 to form a sloped annular wall 64. The male mating sections 65 each comprise three circumferentially spaced teeth 71 with slots therebetween. The outer external edge of each tooth is beveled 79 and a groove 72 extends around the external surface of the teeth 71 as shown most clearly in FIG. 6.

Figure 7B:
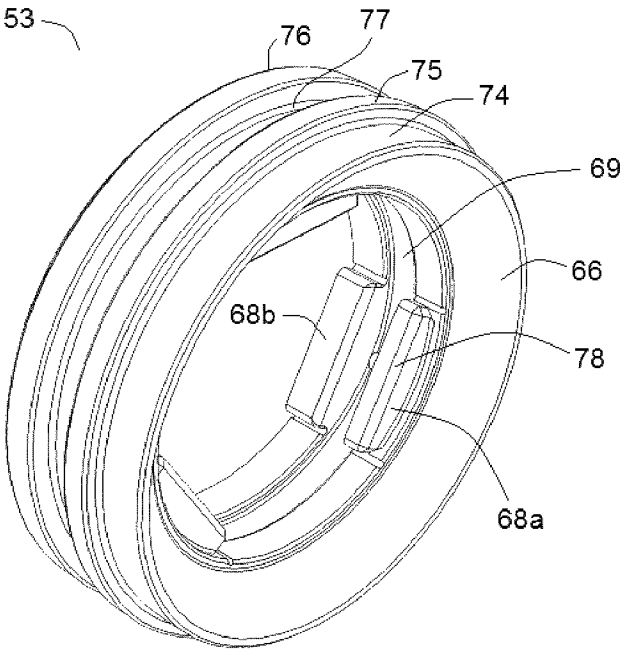
FIGS. 7A is a perspective view of an outer end of the female mating component and FIG. 7B is a perspective view of an inner end of the female mating component.
Figure 7A:
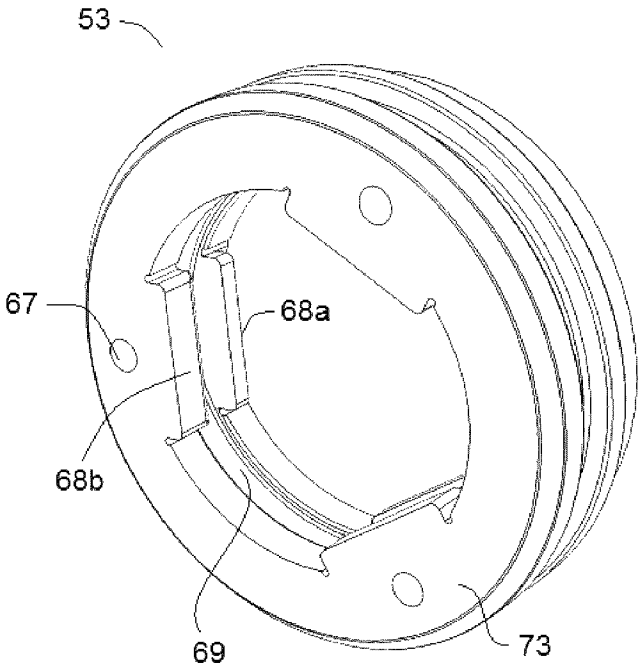

The female mating components 53 comprise a generally ring like structure with an outer end shown in FIG. 7A and an inner end shown in FIG. 7B. The inner end has a sloped annular surface 66 which corresponds in taper to the sloped annular wall 64 of the membrane support 52. The outer end has an end surface 73 with threaded bores 67 equally spaced around the end surface 73. The external surface of each of the female mating components 53 comprises (from inner end to outer end) an annular outer sleeve receiving section 74, a first annular shoulder 75, an annular groove 77, and a second annular shoulder 76. The outer sleeve receiving section 74 is of reduced diameter compared to the first and second annular shoulders 75, 76. The annular groove 77 between the first and second annular shoulders 75, 76 receives an O-ring seal 55 to provide a fluid seal between the motor subassembly housing 49 and the female mating components 53 as shown in FIG. 2. The internal surface of each of the female mating components 53 includes three pairs of projections 68*a*, 68*b* equally spaced around the internal surface of the female mating component 53. Each projection pair comprises an inner projection 68*a* adjacent the inner end of the female mating component 53 and an outer projection 68*b* adjacent the outer end of the female mating component 53 with a channel or space therebetween. The inner internal edge of each of the inner projections 68*a* is bevelled 78. An annular groove 69 extends around the internal surface of each of the female mating components 53 and through the channels between the projection pairs 68*a*, 68*b*.

The membrane sleeve 51 comprises a flexible membrane tube with a bore therethrough and includes a longitudinally extending central portion 59 with an end portion 58 either side of the central portion 59. Each end portion 58 is sloped or tapered such that the bore decreases in diameter from the central portion 59 through each of the end portions 58. The central portion 59 of the membrane sleeve 51 corresponds in length to the central section 61 of the membrane support 52 and the taper of the end portions 58 of the membrane sleeve 51 correspond to the taper of the sloped annular walls 64 of the membrane support 52. The membrane sleeve 51 may be made of a flexible polymer, for example, but not limited to, rubber or some other flexible polymer such as fluorocarbons (for example Viton™) that is able to flex to compensate for pressure changes in the mud and allow the pressure of the lubrication liquid inside the motor subassembly 25 to substantially equalize with the pressure of the external mud.

Each of the retaining rings 80 is a flat incomplete metal ring with a gap that allows the retaining ring 80 to radially expand such that the diameter of the retaining ring 80 increases by pushing out on the internal surface. Such retaining rings 80 are known in the art, for example Smalley's Hoopster® Retaining Rings. In an alternative embodiment (not shown), the retaining ring 80 may comprise two semi-circular sections or more than two sections, which together form a ring like structure that can be radially expanded.

Figure 4:
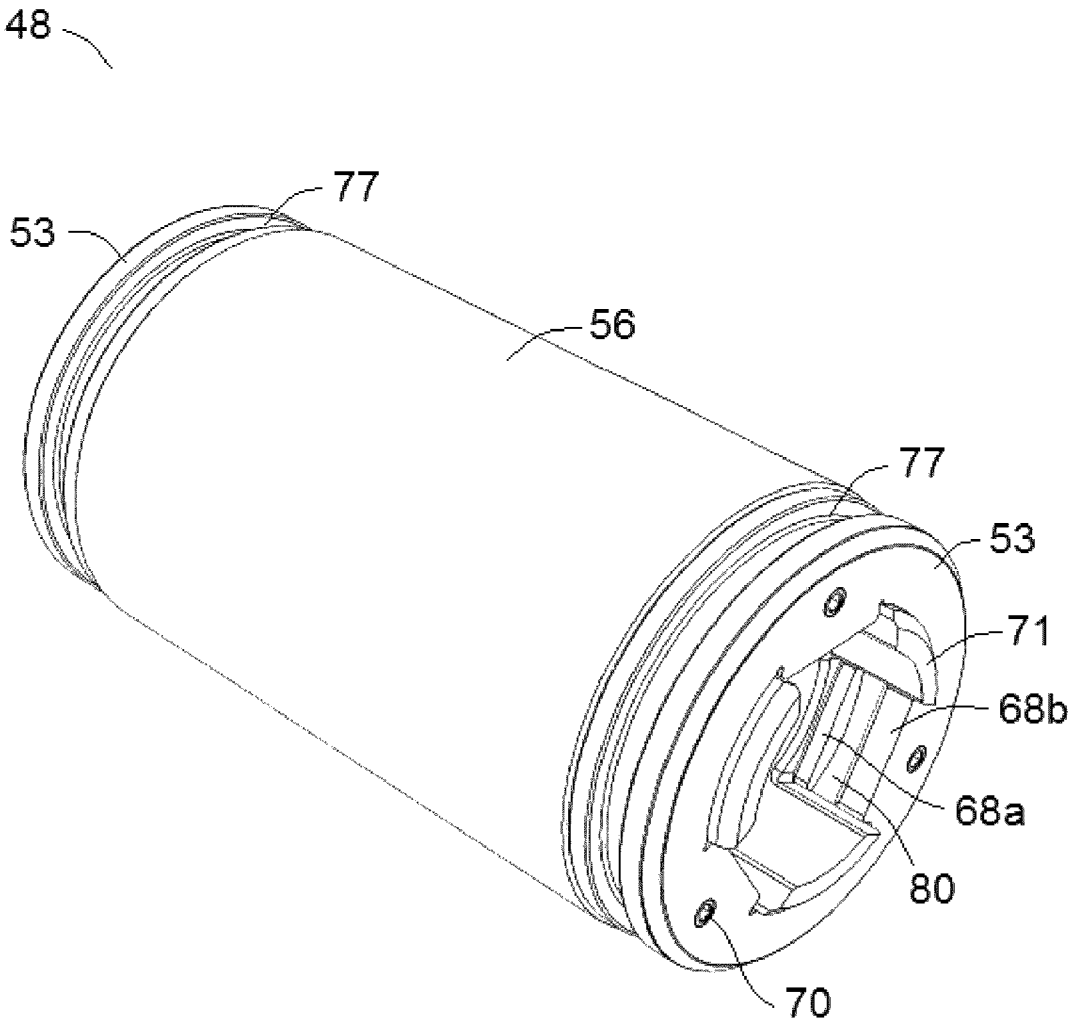
FIG. 4 is a perspective view of the assembled pressure compensation device shown in FIG. 3.
Figure 5:
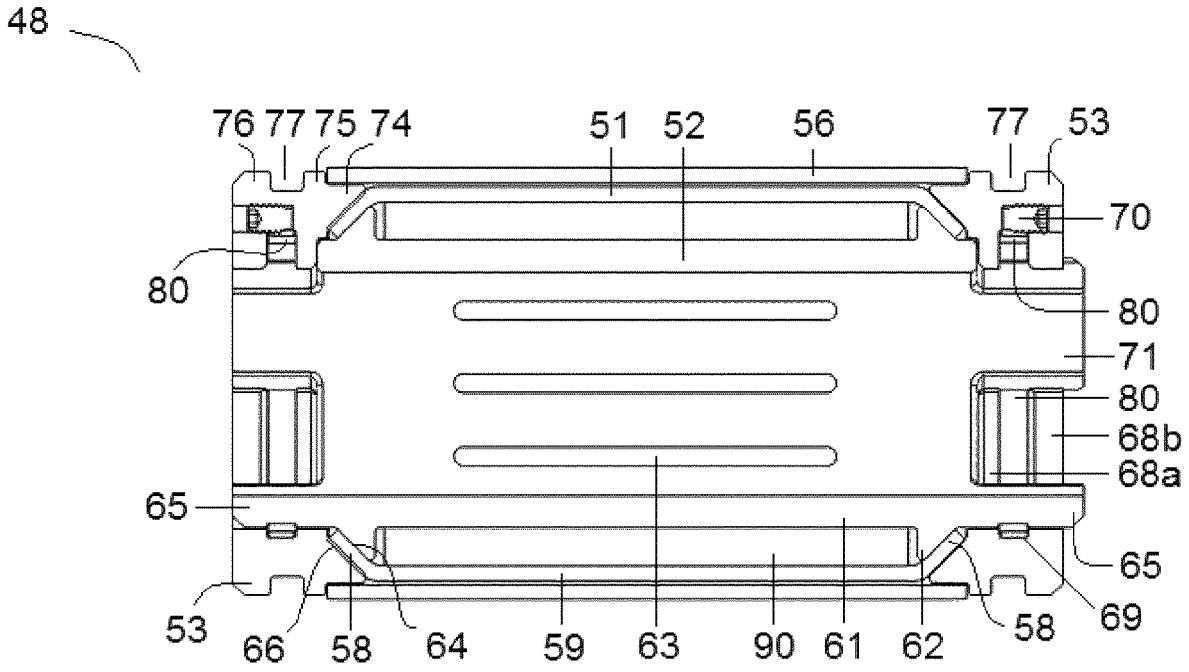
FIG. 5 is a longitudinally sectioned view of the pressure compensation device of FIG. 4.
Figure 6:
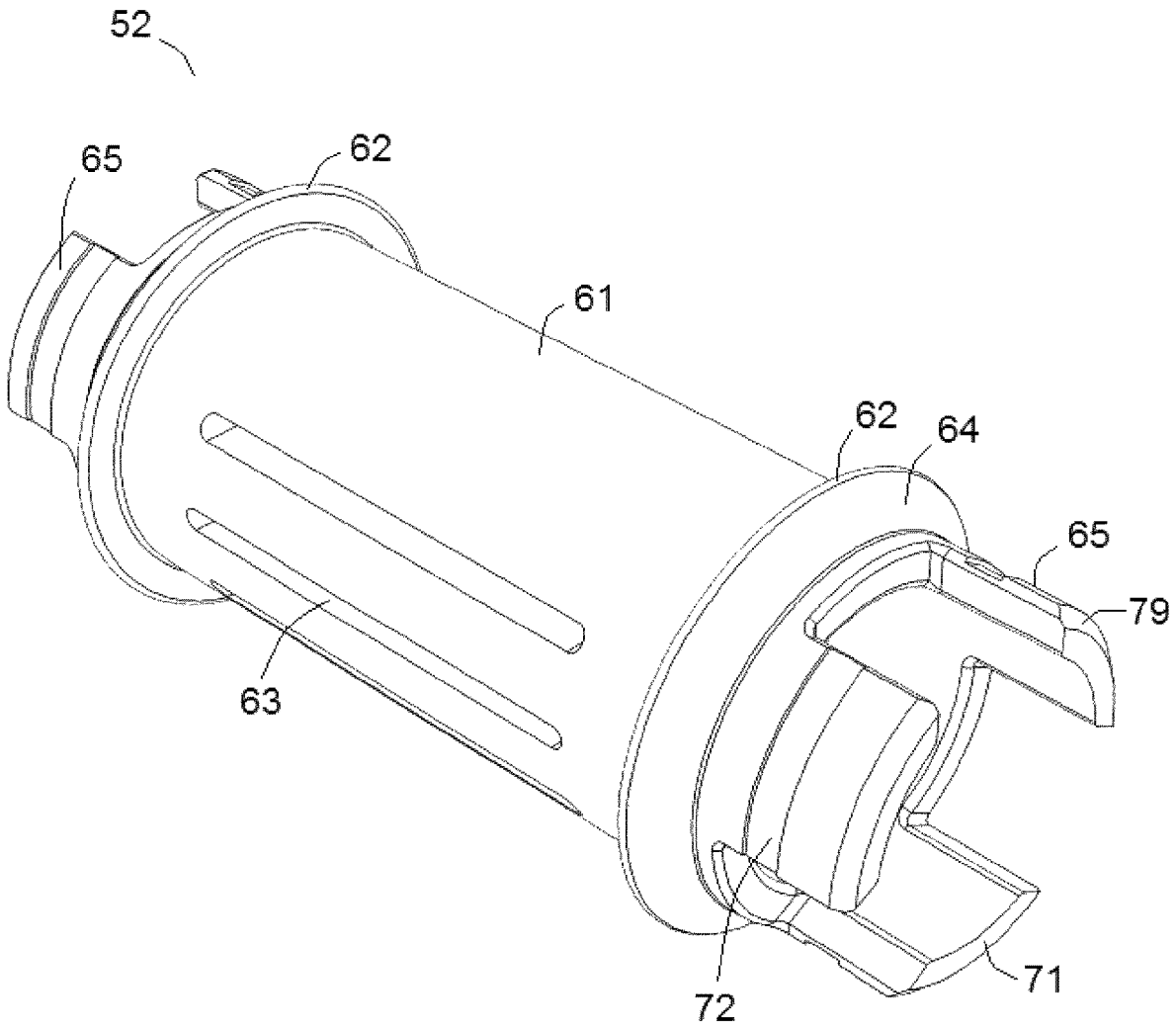
FIG. 6 is a perspective view of the membrane support.

To assemble the pressure compensation device 48, the flexible membrane sleeve 51 is slid over the membrane support 52 until the central portion 59 of the membrane sleeve 51 surrounds the central section 61 of the membrane support 52 and the tapered end portions 58 of the membrane sleeve 51 are each received on one of the sloped annular walls 64 of the membrane support 52 as shown in FIG. 5. Each of the retaining rings 80 is radially contracted by pushing in on the external surface of the ring to decrease its diameter so that it can be inserted inside the inner projections 68*a* of the female mating components 53. When released the retaining ring 80 expands to its normal configuration and is seated in the channels between the projection pairs 68*a*, 68*b*. The female mating components 53 including the retaining rings 80 are mated with the male mating sections 65 at either end of the membrane support 52. More specifically, the inner end of the female mating component 53 is lined up with the male mating section 65 such that the projection pairs 68*a*, 68*b* are received in the slots between the teeth 71. As the female mating component 53 is pushed towards the male mating section 65, the bevelled edges 79 of the teeth 71 push out on the retaining ring 80 which radially expands into the groove 69 in the internal surface of the female mating component 53 and the female mating component 53 and retaining ring 80 are inserted onto the male mating section 65. The teeth 71 of the male mating section 65 interlock with the projection pairs 68*a*, 68*b* of the female mating component 53 as shown in FIG. 4. The sloped annular surface 66 of the female mating component 53 contacts the end portion 58 of the membrane sleeve 51 and the retaining ring 80 snaps into the groove 72 on the external surface of the teeth 71 of the male mating section 65.

Figure 8:
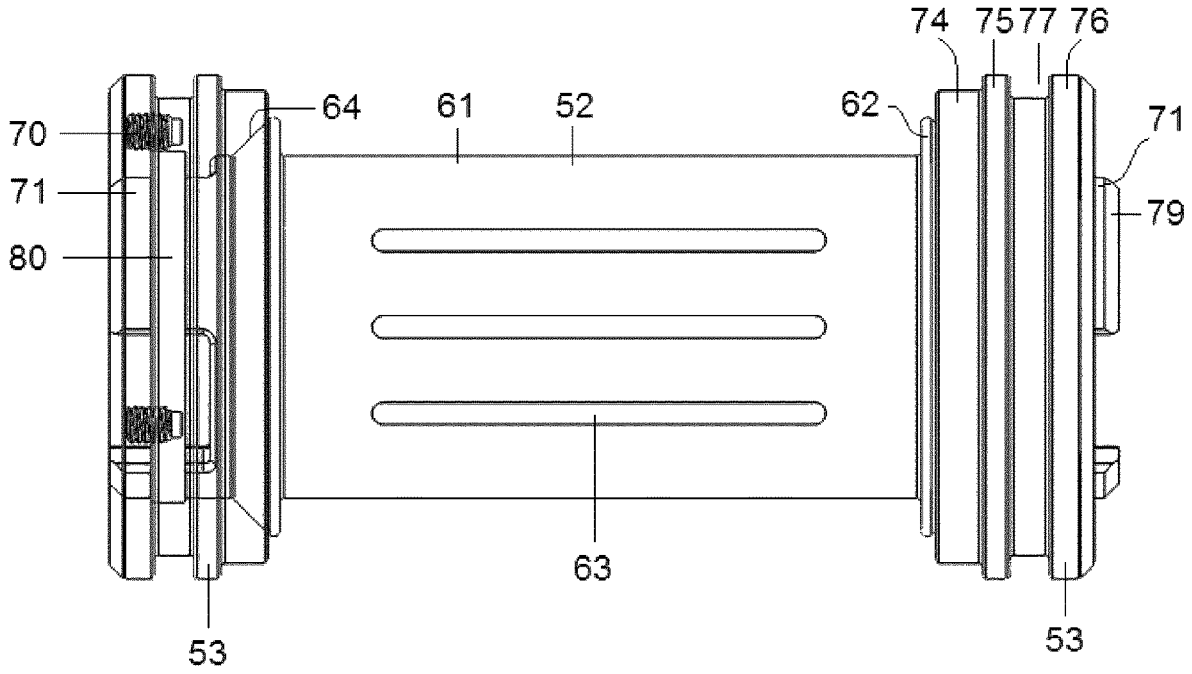
FIG. 8 is a front view of the membrane support with the female mating components and retaining rings mating with opposed ends of the membrane support with one of the female mating components shown as an outline and the other female mating component shown as a solid structure.

Threaded screws 70 are screwed into the threaded bores 67 in the end surface 73 of the female mating component 53 to releasably secure the retaining ring 80 in the groove 72 on the external surface of the teeth 71. As shown in FIGS. 5 and 8, the positioning of the threaded screws 70 is such that it prevents the retaining ring 80 from radially expanding into the groove 69 in the internal surface of the female mating component 53 and disengaging from the groove 72 if there is a sudden impact, shock, vibration of any other force that could force the retaining ring 80 out of the groove 72. In the assembled pressure compensation device 48, there is an annular space between the external surface of the retaining ring 80 and the internal surface of the female mating component 53 provided by groove 69; this annular space allows the retaining ring 80 to be radially expanded to release the female mating component 53 from the male mating section 65 as is described in more detail below. As shown in FIG. 5, a lubrication liquid chamber 90 is formed between the central section 61 of the membrane support 52 and the central portion 59 of the membrane sleeve 51. The outer sleeve 56 may be made of a flexible polymer, for example, but not limited to, rubber or some other flexible polymer such as fluorocarbons (for example Viton™) that allows the outer sleeve to be radially expanded and slid over the annular shoulders 75, 76 of the female mating components 53 and received on the central portion 59 of the membrane sleeve 51 with opposed end portions of the outer sleeve 56 received on the outer sleeve receiving section 74 of each of the female mating components 53.

In the assembled MWD tool 20, the pressure compensation device 48 surrounds the driveshaft 24 and the lubrication liquid chamber 90 is filled with lubrication liquid. O-ring seals 55 positioned in the external annular grooves 77 of the female mating components 53 provide a fluid seal between the motor subassembly housing 49 and the female mating components 53 as shown in FIG. 2. There is a small gap between each end of the outer sleeve 56 and the first annular shoulder 75 of the female mating components 53 allowing mud that has entered the motor subassembly housing 49 via openings 50 to pass into a small annular space between the outer sleeve 56 and the membrane sleeve 51 for pressure equalization of the lubrication liquid contained in the lubrication liquid chamber 90. Each of the end portions 58 of the membrane sleeve 51 is securely clamped between the sloped annular surface 66 of one of the female mating components 53 and one of the sloped annular walls 64 of the membrane support 52 to fluidly separate the lubrication liquid on the internal side of the membrane sleeve 51 from the mud on the external side of the membrane sleeve 51 whilst allowing the membrane sleeve 51 to flex in response to pressure changes for pressure equalization.

It is important that the membrane sleeve 51 remains intact to prevent mud from entering the motor subassembly 25 and damaging the internal components of the motor subassembly 25. The outer sleeve 56 may beneficially provide some protection against wear or direct surface damage to the membrane sleeve 51 caused by mud and this may extend the life span of the membrane sleeve 51. The membrane sleeve 51 may be made of the same material as the outer sleeve 56 or a different material. For example, the material of the outer sleeve 56 may be selected to withstand the high temperatures and harsh drilling environment, as well as the abrasive properties of the external mud which is in contact with the outer sleeve 56, whereas the material of the membrane sleeve 51, while still needing to withstand the high temperatures and harsh drilling environment, may be selected for its compatibility with the lubrication liquid and its pressure compensation properties. In alternative embodiments (not shown) the membrane sleeve 51 may be replaced with a membrane system as described in WO 2014/094179 (incorporated herein by reference) comprising two or more membrane sleeves and an optional thermally resistive layer sandwiched between the membrane sleeves. In a further alternative embodiment (not shown) the outer sleeve 56 may not be present.

If the outer sleeve 56 becomes worn it can be easily replaced. The pressure compensation device 48 can also be easily disassembled to replace the membrane sleeve 51 if needed. More specifically, the threaded screws 70 are removed from the threaded bores 67 and the retaining rings 80 are radially expanded by pushing on the exposed portions of the internal surface of the retaining rings 80 positioned in the channels between the projection pairs 68*a*, 68*b* of the female mating components 53 which are shown in FIG. 4. The retaining rings 80 expand into the grooves 69 on the internal surface of the female mating components 53 such that the retaining rings 80 are unseated from the grooves 72 on the external surface of the teeth 71 and each of the female mating components 53 with retaining ring 80 positioned in groove 69, can be removed from the male mating sections 65 to release the membrane sleeve 51.

In an alternative method of mating the female mating component 53 with the male mating section 65, the retaining ring 80 is radially expanded and positioned in the groove 72 on the external surface of the teeth 71. The female mating component 53 is then inserted onto the male mating section 65 and the bevelled edges 78 of the inner projections 68*a* deflect the retaining ring 80 and the inner projections 68*a* pass over the retaining ring 80 which then snaps back into its normal configuration and is seated in the channels between the projection pairs 68*a*, 68*b* to retain the female mating component 53 on the male mating section 65.

In alternative embodiments (not shown) there may be less than or more than three pairs of projections 68*a*, 68*b* on the internal surface of the female mating components 53 and a corresponding number of teeth 71 on the male mating sections 65 of the membrane support 52, such that the teeth 71 and projection pairs 68*a*, 68*b* interlock. More pairs of projections 68*a*, 68*b* and teeth 71 may increase the rigidity between the mating components; however, the number of projection pairs 68*a*, 68*b* and teeth 71 may be limited by the circumference of the membrane support 52 and female mating components 53.

In further alternative embodiments (not shown) the projection pairs 68*a*, 68*b* and teeth 71 may be replaced by other mating structures which allow the female mating component 53 to mate with the male mating section 65 or there may be no pairs of projections 68*a*, 68*b* and teeth 71 or other mating structures. In these further alternative embodiments, each male mating section 65 has a groove extending around at least a portion of an external surface thereof, and each female mating component 53 has at least one channel extending around at least a portion of an internal surface thereof. The channel may be provided by a groove on the internal surface of the female mating component 53 or may be provided by projections (such as projection pairs 68*a*, 68*b*) that extend out from the internal surface or that are fixed to the internal surface of the female mating component 53. There is at least one opening through the body of each of the male mating sections 65 which is in alignment with the groove on the external surface of the male mating section 65. This opening may be a window or aperture through the body or a sectional cut away of the body as provided in the embodiment shown in FIGS. 3 to 8. The retaining rings 80 are received in the channel of one of the female mating components 53 and in the groove of one of the male mating sections 65 such that the retaining ring 80 is positioned between the male mating section 65 and the female mating component 53 to retain the female mating component 53 on the male mating section 65. For example, in one embodiment (not shown) the channel is an annular groove extending around the internal surface of each of the female mating components 53 and the retaining ring 80 is of a thickness that an internal portion of the retaining ring 80 is positioned in the groove on the external surface of the male mating section 65 and an external portion of the retaining ring 80 is positioned in the groove on the internal surface of the female mating component 53 to retain the female mating component 53 on the male mating section 65. As discussed above, threaded screws 70 or the like may be threaded into bores 67 in the female mating component 53 to prevent the retaining ring 80 from radially expanding and becoming unseated from the groove on the external surface of the male mating section 65. The depth of the groove on the internal surface of the female mating component 53 is such that there is an annular space between the surface of each of the female mating components 53 and the external surface of the retaining ring 80. The internal surface of the retaining ring 80 is accessible through the opening in the male mating section 65 and the retaining ring 80 can be radially expanded into the annular space to unseat the retaining ring 80 from the groove on the external surface of the male mating section 65 such that the female mating component 53 and retaining ring 80 can be removed from the male mating section 65 to release the membrane sleeve 51.

In some embodiments the configuration of one of the female mating components 53 and one of the male mating sections 65 may be different to the other female mating component 53 and male mating section 65.

While particular embodiments have been described in the foregoing, it is to be understood that other embodiments are possible and are intended to be included herein. It will be clear to any person skilled in the art that modifications of and adjustments to the foregoing embodiments, not shown, are possible. For example, in alternative embodiments (not shown), the fluid pressure pulse generator 30 may be positioned at the uphole end of the MWD tool 20.

The invention claimed is:

1. A pressure compensation device for a downhole fluid pressure pulse generating apparatus comprising:

(a) a membrane sleeve;

(b) a membrane support comprising a body with a bore therethrough for receiving a driveshaft of the fluid pressure pulse generating apparatus, the body comprising a central section which receives the membrane sleeve and a male mating section either side of the central section, each male mating section having a groove extending around at least a portion of an external surface thereof and at least one opening therethrough aligned with the groove;

(c) a pair of female mating components each comprising an inner end and an outer end with a bore therethrough and at least one channel extending around at least a portion of an internal surface thereof, each of the female mating components configured to mate with one of the male mating sections to axially clamp the membrane sleeve between the body and the female mating components; and (d) a pair of retaining rings each received in the channel of one of the female mating components and in the groove of one of the male mating sections such that the retaining ring is positioned between the male mating section and the female mating component to retain the female mating component on the male mating section, wherein the retaining ring is accessible through the opening in the male mating section and radially expandable into a space between the retaining ring and the female mating component to unseat the retaining ring from the groove for removal of the female mating component from the male mating section.

2. The pressure compensation device of claim 1, further comprising an outer sleeve surrounding the membrane sleeve with a space therebetween.

3. The pressure compensation device of claim 2, wherein each of the female mating components comprises an outer sleeve receiving section on an external surface thereof which receives an end portion of the outer sleeve with a space therebetween.

4. The pressure compensation device of claim 1, wherein the membrane support further comprises a pair of shoulders surrounding the body, with each shoulder positioned between the central section and one of the male mating sections.

5. The pressure compensation device of claim 4, wherein each of the shoulders taper towards the male mating sections to form a sloped wall, and the inner end of each of the female mating components has a sloped surface, whereby the membrane sleeve is axially clamped between the sloped wall and the sloped surface when the female mating component is mated with the male mating section.

6. The pressure compensation device of claim 5, wherein the membrane sleeve comprises a central portion and a sloped end portion either side of the central portion, wherein the taper of the sloped end portion corresponds to the taper of the sloped wall and each sloped end portion is axially clamped between one of the sloped walls and the sloped surface of one of the female mating components.

7. The pressure compensation device of claim 1, wherein the central section of the body of the membrane support further comprises at least one longitudinally extending slot therethrough.

8. The pressure compensation device of any one of claim 1, wherein at least one of the female mating components comprises one or more pair of projections comprising an inner projection and an outer projection on an internal surface thereof with the channel extending between the inner projection and the outer projection, and at least one of the male mating sections comprises a corresponding number of teeth defining one or more slot therebetween whereby the groove extends around an external surface of the teeth and the opening through the body is provided by the slot, wherein the slot receives the pair of projections when the female mating component is mated with the male mating section.

9. The pressure compensation device of claim 8, wherein an outer external edge of the teeth is bevelled.

10. The pressure compensation device of claim 8, wherein an inner internal edge of the inner projection is bevelled.

11. The pressure compensation device of claim 1, wherein the outer end of at least one of the female mating components comprises one or more threaded bore for receiving a threaded screw for releasably securing the retaining ring in the groove on the external surface of the male mating section.

12. A fluid pressure pulse generating apparatus for downhole drilling comprising a fluid pressure pulse generator and a pulser assembly comprising:

a housing with one or more opening therethrough;

a motor enclosed by the housing;

a driveshaft extending from the motor out of the housing and coupled with the fluid pressure pulse generator;

the pressure compensation device of claim 1 enclosed by the housing and surrounding a portion of the driveshaft, wherein an outer surface of the membrane is in fluid communication with the opening in the housing and an inner surface of the membrane is in fluid communication with a chamber between the driveshaft and the membrane; and a seal enclosed by the housing and surrounding a portion of the driveshaft between the fluid pressure pulse generator and the pressure compensation device.

* * * * *